United States Patent [19]

Urani et al.

[11] Patent Number: 4,968,269

[45] Date of Patent: Nov. 6, 1990

[54] FUSE HOLDER

[75] Inventors: Angelo Urani; William G. Herbert, both of Ellisville, Mo.

[73] Assignee: Cooper Industries, Inc., Houston, Tex.

[21] Appl. No.: 173,410

[22] Filed: Mar. 25, 1988

[51] Int. Cl.[5] ..... H01R 33/95

[52] U.S. Cl. ..... 439/622; 439/621

[58] Field of Search ..... 439/622, 621

[56] References Cited

U.S. PATENT DOCUMENTS

| | | | |
|---|---|---|---|
| 3,891,292 | 6/1975 | Blight | 339/36 |
| 4,060,303 | 11/1977 | Wilczynski | 439/622 |
| 4,072,385 | 2/1978 | Wallner | 339/88 |
| 4,448,476 | 5/1984 | Perlman et al. | 339/203 |
| 4,504,815 | 3/1985 | Harwath | 439/622 X |
| 4,536,054 | 8/1985 | Wallner et al. | 439/622 X |
| 4,826,454 | 5/1989 | Kissling et al. | 439/621 |

OTHER PUBLICATIONS

Page from Bussman Apr. 1988, catalog showing fuse-holders.

*Primary Examiner*—Eugene F. Desmond

*Attorney, Agent, or Firm*—Donald Verplancken; David Alan Rose

[57] ABSTRACT

The fuse holder for receiving a cylindrical fuse having conductive ends includes a cap having a fuse carrier disposed in part therein for receiving one end of the fuse and a barrel having a fuse cavity for receiving the cap and fuse. The barrel includes a bottom terminal extending through the barrel for contact with one conductive end of the fuse and a side terminal having tines extending through apertures in the side of the barrel for engagement with the fuse carrier which in turn is in electrical contact with the other end of the fuse. The body of the side terminal is disposed on the exterior of the barrel and, in conjunction with the wall of the barrel, isolates the interior of the barrel from the body of the side terminal such that only that portion of the side terminal required to complete the electrical path from the fuse carrier to the side terminal is exposed interior the barrel.

5 Claims, 5 Drawing Sheets

FUSE HOLDER

BACKGROUND OF THE INVENTION

This invention relates to fuse holders and more particularly to fuse holders in which the side terminal is assembled from the exterior of the barrel of the fuse holder and the connection between the side terminal and fuse carrier is disposed interior of the barrel.

A fuse holder is a device for retaining an electrical fuse in a wired circuit A standard fuse holder is comprised of a barrel, a cap, and means for electrically connecting the fuse holder and fuse, which the fuse holder retains, to an electrical circuit. Commonly, the means for connecting the fuse holder to a circuit is a male terminal which is sized to fit standard female wiring terminals. The fuse holder operates by electrically insulating the fuse from the environment exterior the fuse holder while creating an electrically conductive circuit from one terminal, through the fuse holder and fuse, to the second terminal. The fuse holder is typically constructed into cap and barrel sections, and incorporates some means for disassembly to facilitate removal and replacement of the fuses.

Two types of cylindrical fuses are commonly used to fuse circuits to which this invention applies. The first type is the American-style fuse, which is a cylinder approximately ¼ of an inch in diameter and 1¼ inches in length. The other is the European-style fuse, which is approximately 5 mm in diameter and 20 mm in length. Fuse holders are commonly constructed to hold both types of fuses, although the European-style is both shorter and slimmer than the American-style fuse.

One type of fuse holder known in the prior art has a fuse holding barrel which retains one end of a fuse and two electrical wiring access terminals, and a cap which retains the other end of the fuse and completes the electric path between the two electrical access terminals when the cap is inserted in the barrel. To facilitate the contact with the fuse, the bottom terminal is connected to the base of the barrel with a protrusion projecting interior the barrel, and the side terminal is placed interior the barrel and has a protrusion which projects through the wall of the barrel for wiring access. The cap contains an integral conductor which both physically and conductively engages the fuse, and which upon assembly of the cap and fuse within the barrel completes an electric circuit by conductively engaging the side terminal inside the barrel. To reduce the risk of shock and arcing which could occur when the fuse holder cap is removed, and to meet safety standards, an insulating sleeve or spacer-sleeve is disposed interior the barrel between the fuse and the barrel wall, such that only the portion of the side terminal substantially in contact with the cap conductor is exposed to the interior of the barrel. Thus, this type prior art fuse holder, disposing the side terminal within the fuse holder, requires an internal spacer-sleeve to insure that the fuse holder is shockproof, i.e., that the internal exposed live metal is not accessible to the user when holding the fuse carrier with the fuse installed or with the standard I.E.C. test finger. When the spacer sleeve is used, the sleeve must first be assembled to the side terminal, and then the subassembly must be guided blindly into a receiving aperture inside the fuse holder barrel.

U.S. Pat. No. 4,448,476 describes a type of fuse holder which does not use the insulating sleeve. Rather, the bottom and side terminals are molded into the body of the barrel such that only the contact points of the bottom and side terminals are exposed interior the barrel. This reduces the risk of shock or arcing when a fuse is inserted or removed from the fuse holder.

U.S. Pat. No. 3,891,292 also discloses a fuse holder having side and bottom terminals with an insulating sleeve located within an interior tubular contact. The side terminal is located within the barrel in this construction by placement from within the barrel through an aperture located in an undercut on the exterior of the body. Electrical contact from the side terminal to the fuse is maintained through a tubular contact and through a conductive spring to a fuse. A circular lip in the interior of the barrel isolates the side terminal from the interior of the barrel, and an insulating sleeve disposed interior the tubular contact electrically isolates the tubular contact from the interior of the fuse holder.

Some prior art fuse holders have a side terminal which is assembled from the outside of the fuse holder, but their point of electrical contact to the fuse carrier is also exposed on the outside of the assembled fuse holder. Such an assembly makes the connection between the side terminal and fuse carrier susceptible to contamination from foreign particles, corrosion, or damage during handling or assembly. Other prior art fuse holders have a side terminal which is assembled from the outside of the fuse holder, but do not have a cap which is substantially fully retained within the fuse holder barrel, and the point of making electrical contact is outside the barrel or the assembly requires the use of a sleeve.

Other objects and advantages of the present invention will become apparent from the following description.

SUMMARY OF THE INVENTION

The fuse holder for receiving a cylindrical fuse having conductive ends includes a cap having a fuse carrier disposed in part therein for receiving one end of the fuse and a barrel having a fuse cavity for receiving the cap and fuse. The barrel includes a bottom terminal extending through the barrel for contact with one conductive end of the fuse and a side terminal having tines extending through apertures in the side of the barrel for engagement with the fuse carrier which in turn is in electrical contact with the other end of the fuse. The body of the side terminal is assembled and thus disposed on the exterior of the barrel and, in conjunction with the wall of the barrel, isolates the interior of the barrel from the body of the side terminal such that only that portion of the side terminal required to complete the electrical path from the fuse carrier to the side terminal is exposed interior the barrel.

The object of this invention is to provide a fuse holder which is comprised of a minimum of parts and in which the cap is retained substantially within the barrel and the side terminal is assembled from outside the inner barrel and makes electrical contact within the barrel and which, in conjunction with the fuse holder barrel, eliminates the need for an insulating sleeve. Further, although the side terminal is assembled from outside the barrel, the electrical connection between the side terminal and fuse carrier is disposed inside the barrel.

BRIEF DESCRIPTION OF THE DRAWINGS

The above and other objects and advantages of the present invention will become apparent from the following description when read in conjunction with the accompanying drawings, wherein.

DESCRIPTION OF THE PREFERRED EMBODIMENT

Figure 1:
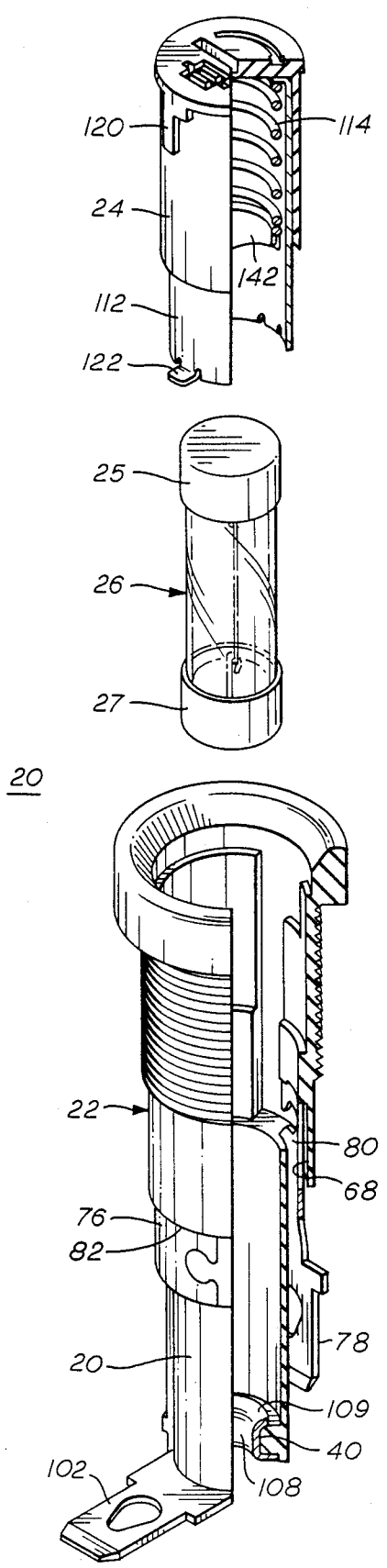
FIG. 1 is an exploded view, partially in section, of the fuse holder showing the alignment of the cap, fuse and barrel.

Referring initially to FIG. 1, the fuse holder 20 of the present invention includes a barrel 22 having a side terminal 76 mounted on its exterior and a bottom terminal 102 disposed on one terminus, and a cap 24 having a fuse carrier 112 received in part therein and a spring 114 disposed within the cap 24. One end 25 of an American-style fuse 26 is received within the fuse carrier 112 and is in electrical contact therewith. Simultaneously the fuse 26 abuts against the end of the spring 114. The cap 24, with the fuse disposed therein, is received within the barrel 22 of fuse holder 20. The other end 27 of the fuse 26, opposite the spring 114, conductively engages the bottom terminal 102 having a ferrule 108 projecting through the bottom of the barrel 22 so as to be exposed for contact with the fuse 26. Likewise, the side terminal 76 includes tines 80, 82 projecting through the side of the barrel 22 which engage the fuse carrier 112 inside the barrel 22 to complete the electric circuit. The engagement of the fuse carrier 112 with the tines 80, 82 connects the cap 24 within the barrel 22. The spring 114 insures electrical contact of the fuse 26 within the fuse carrier 112 and barrel 22. No insulating sleeve is required.

Figure 2:
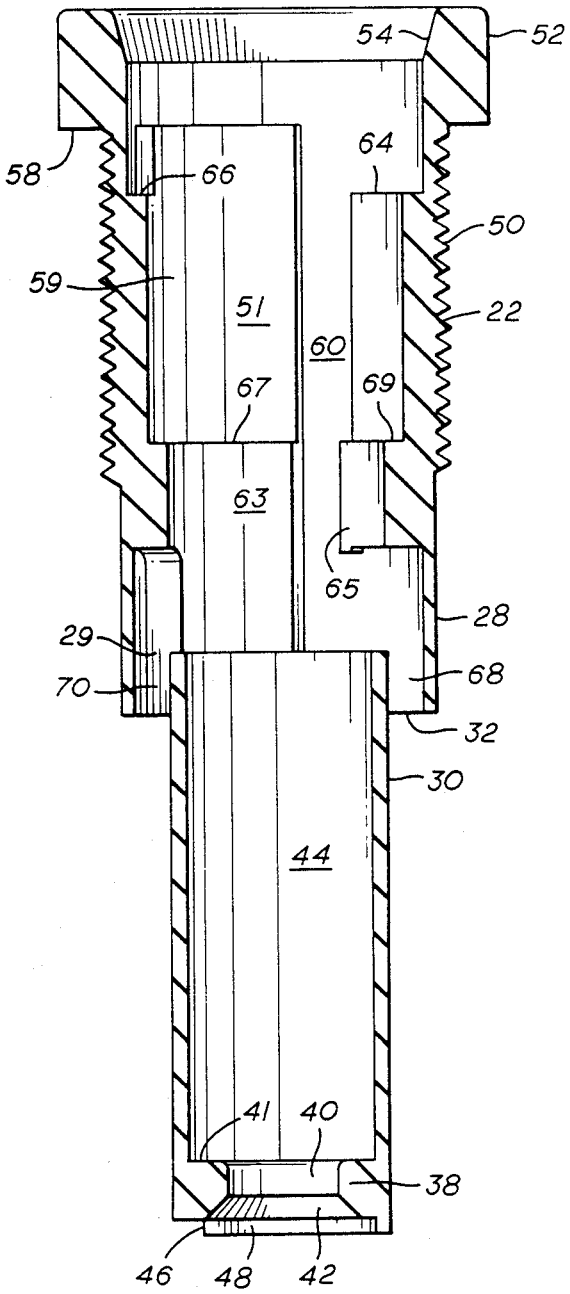
FIG. 2 is a cross-sectional view of the fuse holder barrel shown in FIG. 1.
Figure 3:
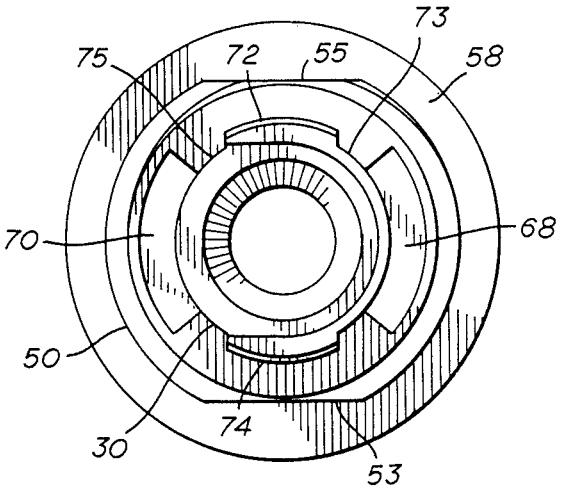
FIG. 3 is an bottom view of the fuse holder barrel shown in FIG. 2.

Referring now to FIGS. 2 and 3 illustrating the barrel 22 of the fuse holder 20, the barrel 22 is preferably made of plastic and has a generally tubular-shaped body. The body of the barrel 22 includes a major diameter tubular portion 28 and a minor diameter tubular portion 30. At the time of the molding of the body of barrel 22, the major diameter portion 28 and minor diameter portion 30 are designed to overlap at 29 and to form an annular wall 32.

The major diameter tubular portion 28 includes a generally cylindrical interior bore 51 for receiving the cap 24. The major diameter portion 28 includes a head at the tapered entrance or mouth 54 of the bore 51. The tapered entrance 54 facilitates the insertion of the cap 24 into the bore 51. The mounting section of cap 52 is circular in cross section and has an enlarged diameter so as to form an annular bearing surface 58. Exterior threads 50 are disposed on the external surface of the major diameter portion 28 for mounting in a electrical panel. Two longitudinal anti-rotation flats 53, 55 are provided over the external threads 50 on each side of the major diameter portion 28. Upon mounting the fuse holder 20 into an electrical panel (not shown), the electrical panel has corresponding anti-rotation flats in its receiving aperture whereby upon inserting the barrel 22 into the aperture of the electrical panel, the anti-rotation flats 53, 55 mate with the flats in the aperture of the electrical panel to prevent rotation of the barrel 22 within the panel aperture. The barrel 22 is inserted into the aperture of the electrical panel such that the bearing surface 58 bears against one side of the electrical panel since the cap 52 has a diameter greater than that of the panel aperture. A nut, not shown, is threaded onto the exterior threads 50 until tight from the other side of the panel, the anti-rotation flats preventing the barrel 22 from rotating while the nut is being secured. The nut bears on the rear of the panel to secure the fuse holder 20 to the electrical panel. Opposed secondary flats 57 are provided to allow the use of a snap band (not shown), rather than a nut as described above, which snaps over and engages flats 57 to secure the fuse holder 20 to the panel.

The interior bore 51 of major tubular diameter portion 28 is configured to receive and house the fuse carrier 112. The interior cylindrical wall of the bore 51 includes alternating alignment bosses 59, 61 forming slots 60 for receiving the contacts 122, 140 of the fuse carrier 112 and to attach the cap 24 within the barrel 22 as hereinafter described in further detail. The alignment bosses 59, 61 do not have a common inner diameter the entire length of interior bore 51 but include smaller diameter portions which form ledges 67, 69 and traversing slots 63, 65. Arcuate ledges 64, 66 are provided in alignment bosses 59, 61, respectively, adjacent the mouth 54 for the purpose of guiding the contacts 122, 140 of the fuse holder 112 into the longitudinal slots 60.

As shown in FIG. 2, arcuate apertures 68, 70 are provided extending through the overlap 29 between the major tubular diameter portion 28 and minor tubular diameter portion 30. These apertures 68, 70 extend through the annular wall 32 into traversing slots 63, 65, respectively. The ledges 64, 66 abut the terminal and fuse carrier 112 to limit its reception into internal bore 51. As will be further described hereinafter, apertures 68, 70 receive tines 80, 82 to expose tines 80, 82 to the contacts 122, 144 of the fuse carrier 112 for electrical contact therewith.

Minor tubular diameter portion 30 is illustrated in FIGS. 2 and 3. Minor diameter portion 30 includes a generally tubular-shaped body having a blind bore for a fuse cavity 44. The diameter of the fuse cavity 44 is sized such that the fuse 26 can be easily inserted into the cavity without binding. The closed end 38 of minor tubular diameter portion 30 includes an aperture 40 for receiving the ferrule 108 of the bottom terminal 102. The aperture 40 includes a crimp retainer 41 and counterbore 42 corresponding to the shape of the ferrule 108 and end of the bottom terminal 102 whereby that portion of the bottom terminal 102 is recessed into the blind end 38 of minor tubular diameter portion 30. The end 38 is generally circular and has a gap 46 and flange 48 conformed to receive that portion of the bottom terminal 102 as shown in FIG. 1.

Figure 4:
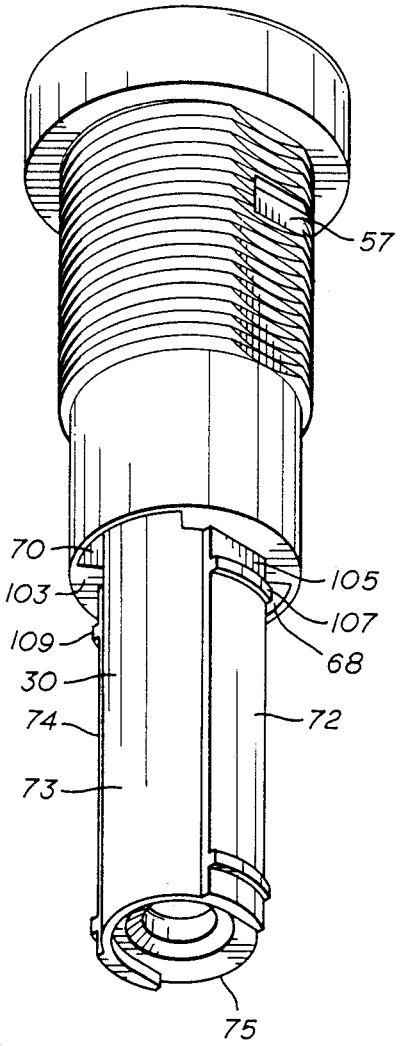
FIG. 4 is a perspective view of the fuse holder barrel shown in FIG. 2.

As shown in FIG. 4, the external surface of minor tubular diameter portion 30 includes two longitudinal alignment splines 72, 74 diametrically opposed from each other. The alignment splines 72, 74 form slots 73, 75 which are aligned with apertures 68, 70. The crimp band 84 of the side terminal 76 is shaped so as to conform with the splines 72, 74 and slots 73, 75 whereby the tines 80, 82 are guided into apertures 68, 70, as hereinafter further described. The alignment splines 72, 74 include crimp shoulders 107, 109 and crimp recesses 103, 105 to receive the crimp section 92 of the crimp band 84 upon crimping crimp band 84.

Figure 5:
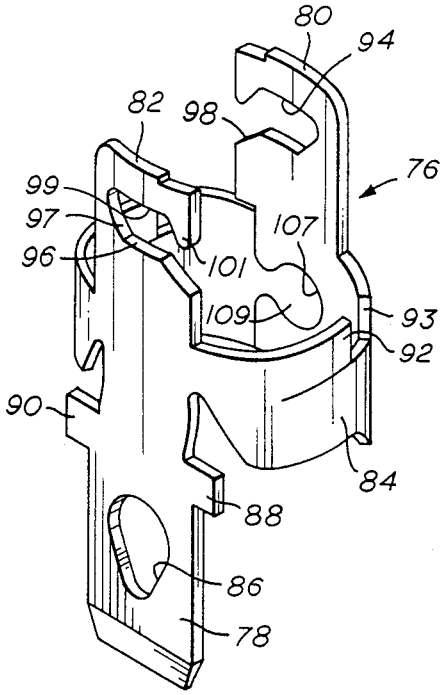
FIG. 5 is a perspective view of the side terminal shown in FIG. 1.

Referring now to FIG. 5, the side terminal 76 is made of a copper-alloy, such as brass or other electrically conductive metal, and includes the tines 80, 82 and an electrical connector 78 extending from the crimp band 84. The tines 80, 82 are arcuate-shaped rectangular ears projecting from the crimp band 84. The tines 80, 82 are sized and shaped to be received within the arcuate apertures 68, 70 of barrel 22. Tines 80, 82 are circumferentially disposed on the crimp band 84, approximately 180° apart. The free ends of the tines 80, 82 include cutouts or slots 94, 96 for receiving the contacts 122, 140 of the fuse carrier 112. The slots 94, 96 traverse the longitudinal dimension of the tines 80, 82 and are shaped to receive and engage the contacts 122, 140. A cam surface 97 is provided to guide the contacts 122, 140 to the upper edge 99 of slots 94, 96 whereby a projecting ear 101, extending into the slots 94, 96, will engage the corresponding edges of contacts 122, 140 to prevent the removal of the contacts 122, 140 from slots 94, 96 upon the mere rotation of the fuse carrier 112 within barrel 22. Ears 101 will require that the fuse carrier 112 is first moved longitudinally downward into the barrel 22 and then rotated to achieve the disengagement of contacts 122, 140 from slots 94, 96. An entry cam surface 98 is provided at the entrance of slots 94, 96 to facilitate the reception of the contacts 122, 140 into the slots 94, 96.

The electrical connector 78 extends from the crimp band 84 on a side opposite one of the tines 80, 82. The electrical connector 78 includes a teardrop-shaped aperture 86 for the receipt and soldering of an electrical wire to be attached to the fuse holder 20. Ears 88, 90 extend from electrical connector 78, which serve as limit stops for the entry of a female terminal onto the connector 78.

The crimp band 84 is bent into a shape to conform to the external surface of minor tubular diameter portion 30 of barrel 22. The crimp band 84 is generally oval. The ends of the crimp band 84 are attached by a slot 107 and head 109. The sides of the crimp 84 between the tines 80, 82 include crimp sections 92 to assist in the collapse of crimp band 84 so as to conform to the external shape of the minor tubular diameter portion 30 of barrel 22 upon assembly. A small cut-away or slot 93 is provided at the end of the crimp sections 92 to assist in the crimping of the crimp band 84 around portion 30.

Figure 6:
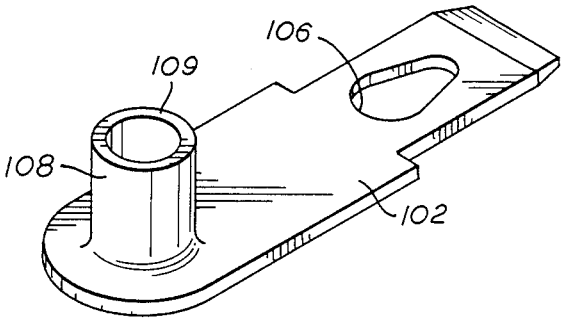
FIG. 6 is a perspective view of the bottom terminal shown in FIG. 1.

Referring now to FIG. 6, the bottom terminal 102 is made of an electrically conducting metal and includes a ferrule 108 projecting from one end of a rectangular-shaped strip of the metal. The free end of the ferrule 108 includes a rolled edge 109 to facilitate its insertion into aperture 40 in the end of barrel 22. The ferrule 108 is cylindrical-shaped. The bottom terminal 102 also includes a teardrop-shaped aperture 106 for receiving and soldering a wire to be connected to the fuse holder 20. The spade terminals or connector 78 of terminal 76 and the connector of terminal 102 may be varied in size and shape and yet fulfill the objectives of the present invention.

Figure 7:
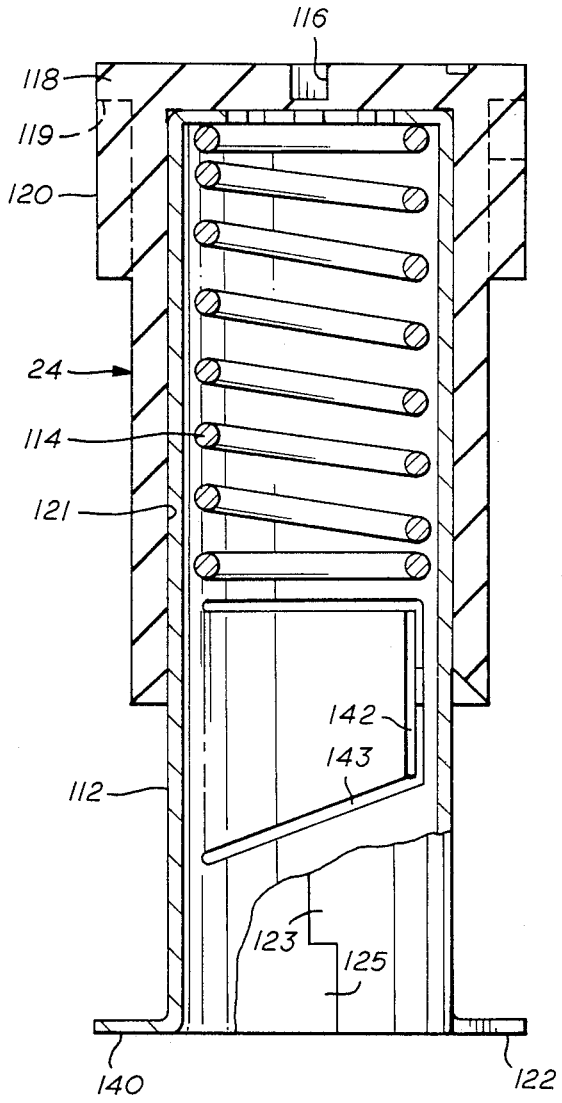
FIG. 7 is a cross-sectional view of the cap, spring, and fuse holder shown in FIG. 1.

Referring now to FIG. 7, there is illustrated the cap 24, fuse carrier 112, and spring 114. The cap 24 includes an enlarged diameter portion or head 118 forming a bearing surface 119 for engagement with the upper end of alignment bosses 59, 61 to limit the insertion of the cap 24 into the barrel 22. The cap 24 further includes on its exterior surface, adjacent head 118, two L-shaped shoulders 120. The longitudinal portion of shoulder 120 is in alignment with the contacts 122, 140 of fuse carrier 112. Thus, the shoulder 120 is received within the slots 60 between alignment bosses 59, 61. A slot 116 is provided in the head 118 for the insertion of a tool, such as a screwdriver, to rotate the cap 24 within the barrel 22. The cap 24 includes a blind bore 121 for receiving the fuse carrier 112.

Figure 8:
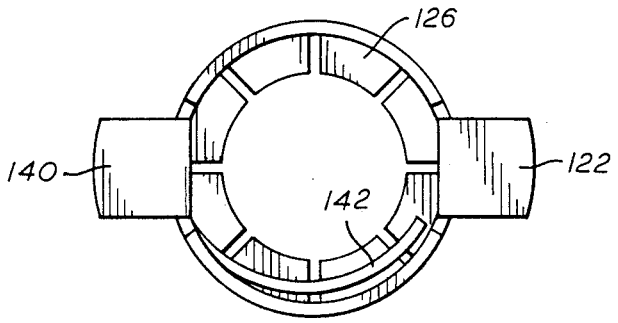
FIG. 8 is a bottom view of the fuse holder shown in FIG. 7.

Referring now to FIGS. 7 and 8, the fuse carrier 112 is made from an electrically conductive metal strip which has been rolled and connected by interdisposed ears and slots 123, 125. The fuse carrier 112 is cylindrical in shape and is sized to receive the fuse 26. The end of the fuse carrier 112 received within the cap 24 includes a plurality of roll crimps 126 which, together with the end of the fuse carrier 112, are glued to the inside surface of the head 118 of the cap 24 to attach the fuse carrier 112 within the cap 24. Roll crimps 126 act as a bearing surface against one end of the spring 114; otherwise, the spring would bear directly on the head 118 and would tend to unseat and detach the fuse carrier 112 glued to the head 118. The exposed free end of the fuse carrier 112 includes a pair of ears or contacts 122, 140, which as previously described, are received within the slots 60 of the barrel 22 for rotation into slots 94, 96 of tines 80, 82. The fuse carrier 112 further includes a spring retainer 142 for retaining the spring 114 within the fuse carrier 112. The spring retainer 142 includes a U-shaped cut-out 143 in the side of fuse carrier 112 which can be bent inwardly to reduce the inner diameter of fuse carrier 112 after spring 114 has been inserted into the bottom of carrier 112 so as to retain the spring 114 within the carrier 112. The inward bending of the spring retainer 142 also reduces the inner diameter of the fuse carrier 112 to create a slight interference between the spring retainer 142 and the standard American fuse 26 thereby assisting in retaining the fuse 26 within the fuse carrier 112.

Referring again to FIG. 1, upon assembly of the bottom terminal 102 and the side terminal 76 into the barrel 22, the ferrule 108 of the bottom terminal 102 protrudes through the bore 40 of barrel 22, and is crimped into place by diametrical expansion of the the rolled edge 109 such that rolled edge 109 of ferrule 108 has a diameter greater than that of the bore 40. Tines 80, 82 of the side terminal 76 protrude through apertures 68, 70, respectively, and the side terminal 76 is secured to barrel 22 by diametrically inward deformation of crimp sections 92 into crimp recesses 103, 105. The ovoid cross section of the side terminal 76 in conjunction with the alignment splines 72, 74 facilities the alignment of the tines 80, 82 with the apertures 68, 70, and crimp sections 92 with crimp recesses 103, 105. The cap 24 is pressed over the end 25 of the fuse 26, and the protruding portion of the fuse carrier 112 and the fuse 26 are inserted into the bore 51 of major diameter portion 28 of the barrel 22. The contacts 122, 140, and shoulder 120 of the cap 24 are aligned with, and fit into slots 60 of the barrel 22. The cap 24 is inserted until the fuse carrier 112 bottoms out, and is then turned in a clockwise direction such that contacts 122, 140 protrude into the J-shaped slots formed by slots 60 and 94, 96. Cap 24 is thus nearly fully deployed within barrel 22. The opposite end 27 of the fuse 26 bears on the rolled edge 109 of ferrule 108. Thus, a continuous circuit is established from first conductor or bottom terminal 102 through the fuse 26 into the fuse carrier 112, through contacts 122, 140, and thereby to the second conductor or side terminal 76. The cap 24 may be turned by the use of a tool, such as a screwdriver, using the slot 116. The fuse 26 may be removed by depressing the cap 24 and rotating in a counterclockwise direction.

Figure 9:
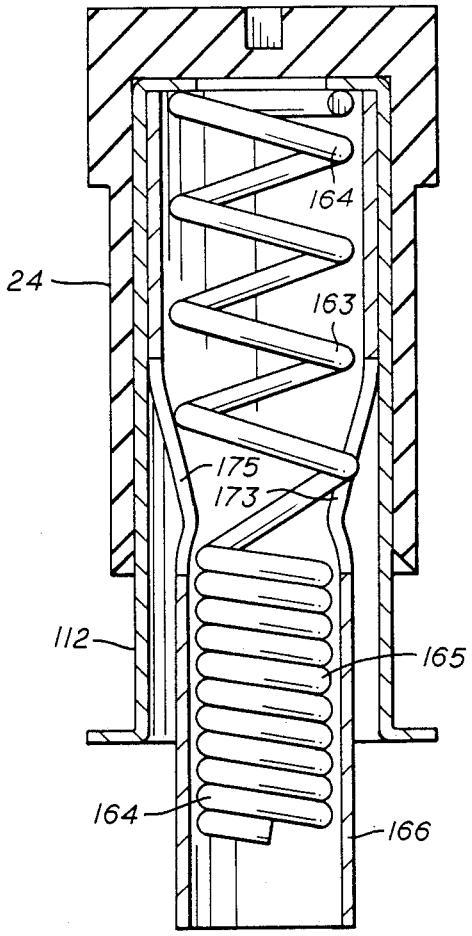
FIG. 9 shows an alternative embodiment of the present invention designed for European-style fuses.
Figure 10:
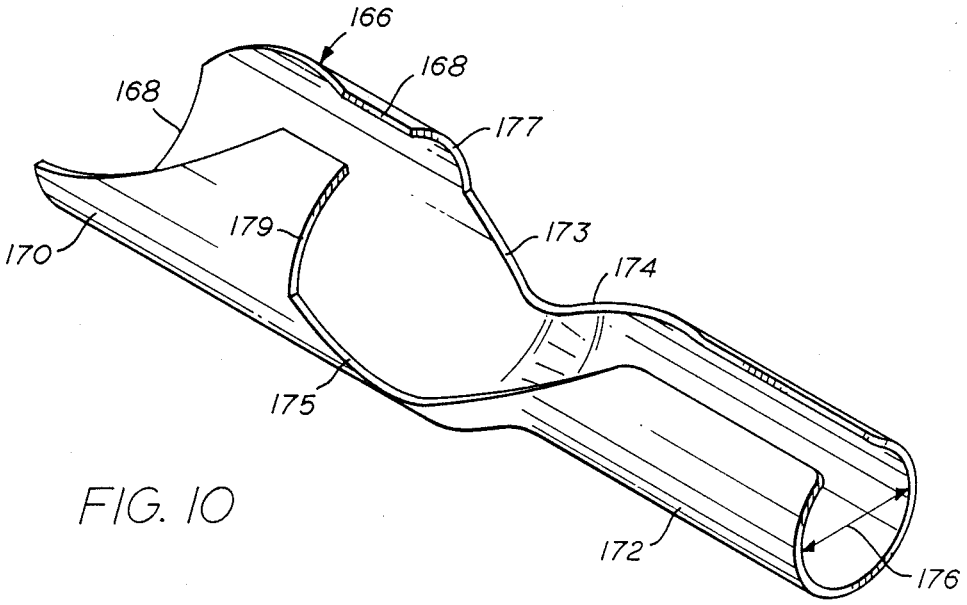
FIG. 10 shows the construction of the adaptor sleeve of the alternative embodiment shown in FIG. 9 used in conjunction with European-style fuses.

Referring to FIGS. 9 and 10, an alternative embodiment of the present invention is shown for use with a European-style fuse. An adaptor sleeve 166 is located within cap 24 and radially disposed between the fuse carrier 112 and extended spring 164. Adaptor sleeve 166 is circular, having a longitudinal cutout 168, major adaptor diameter 170, minor adaptor diameter 172, and taper 174 which blends between major adaptor diameter 170 and minor adaptor diameter 172. Taper 174 further has cutouts 173, 175 and engagement flats 177, 179. Long pitch spring 163 is located interior major adaptor diameter 170, and protrudes through cutouts 173, 175 where it blends into short pitch spring 165 which is disposed interior minor adaptor diameter 172. Extended spring 164 is continuous and comprised of long pitch spring 163 and short pitch spring 165. The inner diameter of minor adaptor diameter 172 is sized such that when European style fuse is inserted therein, a slight interference occurs between the fuse and the inner minor adaptor diameter 176. Engagement flats 177, 179 engage the underside of retainer 142, shown in FIG. 7, to retain the adaptor sleeve 166 within the fuse carrier 112. Thus, when the cap 24 is removed, the fuse will maintain contact with the cap 24 for removal from the fuse holder 20. The adaptor sleeve 166 is further longitudinally sized such that when the European fuse is inserted therein and the cap 24 is inserted into the barrel as shown in FIG. 1, the end of the European fuse opposite the cap 24 makes contact with the bottom terminal 102. Extended spring 164 maintains pressure on the European fuse. When the fuse holder 20 is used with a European fuse, only the configuration of the cap as described herein is changed.

The present invention provides a fuse holder having fewer components than are required in most fuse holders of the prior art and particularly eliminates the need for an internal spacer-sleeve.

The side terminal 76 of the present invention is assembled from the outside of the barrel 22 and the tines 80, 82, projecting through the apertures 68, 70, provide the electrical connecting portion which actually engages and connects with the fuse carrier 112 within the barrel 22. Thus, the connection between the fuse carrier 112 and tines 80, 82 is protected against damage by external means, since it is located inside the barrel 22. Further, the present invention maintains the shockproof feature in that no internal exposed live metal is accessible to the user when holding the fuse carrier with the fuse installed or with the standard IEC test finger. The minor diameter portion 30, molded as a part of the barrel 22, provides the insulation required to maintain this shockproof feature.

While preferred and alternate embodiments of the invention have been shown and described, modifications thereof can be made by one skilled in the art without departing from the spirit of the invention.

We claim:

1. A fuse holder for receiving a fuse having conductive ends, comprising:

a pre-molded barrel to receive the fuse, said barrel having at least one aperture therethrough;

a bottom terminal disposed at one end of said barrel adapted to conductively engage one end of the fuse;

a side terminal disposed on the exterior of said barrel and having at least one tine protruding through said aperture;

a cap having a fuse carrier adapted for receiving the other end of the fuse, said cap and fuse carrier being received by and substantially within said barrel, said fuse carrier engaging said side terminal within said barrel;

said barrel including a major member and a minor member said minor member having an external dimension less than that of said major member and said aperture extending through said barrel at the location of a dimension change between said major and minor members;

said minor member including means for guiding said tine of said side terminal into said aperture; and said guiding means including at least one spline on the exterior of said minor member and engageable with said side terminal.

2. A fuse holder for receiving a fuse having conductive ends, comprising:

a pre-molded barrel to receive the fuse, said barrel having at least one aperture therethrough;

a bottom terminal disposed at one end of said barrel adapted to conductively engage one end of the fuse;

a side terminal disposed on the exterior of said barrel and having at least one tine protruding through said aperture;

a cap having a fuse carrier adapted for receiving the other end of the fuse, said cap and fuse carrier being received by and substantially within said barrel, said fuse carrier engaging said side terminal within said barrel;

said barrel including a major member and a minor member, said minor member having an external dimension less than that of said major member and said aperture extending through said barrel at the location of a dimension change between said major and minor members; and said minor member being generally circular and said side terminal having a ring-like body for receiving said generally circular minor member.

3. The fuse holder of claim 2, wherein the largest diametrical dimension of said side terminal upon assembly on said minor member is less than the outer diameter of said major member.

4. A fuse holder for receiving a fuse having conductive ends, comprising:

a body having adjacent coaxial first and second sections and apertures through said body at the junction of said first and second sections;

a cap adapted to receive the fuse, said sections having a cavity for receiving and circumferentially enclosing said cap and fuse;

a first conductor disposed on said cap and in conductive contact with one end of the fuse;

a second conductor having terminal means adapted for connection to a circuit and at least one contact for attaching said second conductor to said first conductor within said body; said second conductor disposed on the exterior of said body;

a third conductor conductively engaging the other end of the fuse and having terminal means adapted for connection to the circuit;

said contact protruding through said aperture and into the interior of said body and engaging said first conductor for connecting said cap to said body;

biasing means for biasing the fuse into contact with said first and third conductors; and an adapter housed within said fuse carrier for receiving a fuse of reduced size.

5. An apparatus for holding a fuse having conductive ends, comprising:

a cylindrical barrel to receive the fuse, said barrel having a major diameter portion and a minor diameter portion, said major diameter portion having an inner and outer diameter greater than the respective inner and outer diameter of said minor diameter portion, the inner diameter of said minor diameter portion sized to retain the fuse with diametrical clearance;

at least one access aperture extending from the exterior to the interior of said barrel at the intersection of said major and minor diameter portions;

a side terminal having at least one tine sized to extend through said aperture, at least one crimp surface for engagement with the exterior of said minor diameter portion, and a contact adapted for connected to an electrical circuit, said tine having a slot therein;

said access aperture having a recessed portion for receiving said tine such that said tine is recessed into said inner diameter of said major diameter portion;

a bottom terminal having a contact adapted for connection to an electrical circuit and a protrusion which extends through the bottom of said minor diameter portion; said bottom terminal being attached to the bottom of said minor diameter portion;

a fuse carrier having opposed contacts and a spring retainer;

a spring;

a cylindrical cap having an outer circumferential barrel, a retainer lip at one end of said barrel, and a receiving cavity, for receiving said carrier and spring at the opposed end of said barrel;

said retainer lip having an outer circumference less than the greatest inner diameter of said major diameter portion of said barrel;

said spring retainer extending radially inward from said fuse carrier to retain said spring within said fuse carrier;

whereby upon assembly of said cap into said barrel having the fuse disposed therein said cap is entirely receivable within said barrel and an electrical circuit is completed between said bottom terminal, through the fuse into said fuse carrier and through said fuse carrier into said side terminal.

* * * * *